US006417469B1

(12) United States Patent
Tamura

(10) Patent No.: US 6,417,469 B1
(45) Date of Patent: Jul. 9, 2002

(54) ILLUMINATED PUSH BUTTON SWITCH

(75) Inventor: Ken Tamura, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 09/720,076

(22) PCT Filed: Jun. 24, 1999

(86) PCT No.: PCT/JP99/03357

§ 371 (c)(1),
(2), (4) Date: Jan. 31, 2001

(87) PCT Pub. No.: WO99/67799

PCT Pub. Date: Dec. 29, 1999

(30) Foreign Application Priority Data

Jun. 25, 1998 (JP) ..... 10-178374

(51) Int. Cl.[7] ..... H01H 9/16
(52) U.S. Cl. ..... 200/314
(58) Field of Search ..... 200/314, 345

(56) References Cited

U.S. PATENT DOCUMENTS 4,357,511 A 11/1982 Tenner et al. ..... 200/314
4,751,385 A * 6/1988 Van Benthusysen et al. .... 200/314
4,871,890 A * 10/1989 Herrera ..... 200/314
5,456,541 A * 10/1995 Ching-shui ..... 200/345 X
5,661,279 A * 8/1997 Kenmochi ..... 200/314

FOREIGN PATENT DOCUMENTS

| | | |
|---|---|---|
| DE | 196 47 218 | 4/1998 |
| JP | 57-145228 | 9/1982 |
| JP | 59-43023 | 3/1984 |
| JP | 61-53829 | 4/1986 |
| JP | 3-7228 | 1/1991 |
| JP | 3-11662 | 12/1991 |
| JP | 4-92323 | 3/1992 |
| JP | 2550816 | 6/1997 |

* cited by examiner

*Primary Examiner*—Renee Luebke
(74) *Attorney, Agent, or Firm*—Foley & Lardner

(57) ABSTRACT

A switch of high reliability in which built-in components are not detached even when a shock is applied to the switch. A microswitch 4 is actuated by an operative plunger 2, and LEDs 14 are mounted on the same circuit board 5. The switch is configured so that light from the LEDs 14 is diffused and guided to an operation face 10*a* on the upper side by the operative plunger 2. A metal plate 12 is attached into the internal space of the operative plunger 2. According to this configuration, inward bending of the operative plunger 2 due to a shock or the like is prevented from occurring, and engagement between engaging holes 3*b* of a case 3 and engaging protrusions 2*a* of the operative plunger 2 is prevented from being cancelled.

5 Claims, 7 Drawing Sheets

ILLUMINATED PUSH BUTTON SWITCH

TECHNICAL FIELD

The present invention relates to a switch such as an illuminated push button switch.

BACKGROUND ART

As a switch of this kind, for example, an illuminated push button switch, there is a switch that, as shown in FIG. 8, comprises: a switch circuit board 21 on which a microswitch 20 is mounted and which is disposed in a lower portion; and an illumination circuit board 23 on which an LED that is not shown is mounted, and which is disposed in an upper portion so as to be opposed to a glass plate 22 serving as an operation face. The circuit boards are connected to each other by a lead wire 24. When the glass plate 22 is pressed, an operative plunger 25 is downward displaced to turn on the microswitch 20 in the lower portion. This causes the LED that is not shown and that is in the upper portion, to emit light to illuminate the glass plate 22.

In the switch of the conventional art example, however, the switch circuit board 21 on which the microswitch 20 driven by the operative plunger 25 is mounted, and the illumination circuit board 23 for illuminating the operation face must be independently disposed in the lower and upper portions, respectively. Consequently, such a switch has problems in that an extra space is required, and that the cost is high.

In the push button switch, the operation face may be excessively pressed and operated. It is desirable that internal built-in components are not detached even by a shock produced by such severe use.

The invention responds to these problems. It is a principal object of the invention to provide a switch in which the space can be reduced and the cost can be lowered. It is another object of the invention to provide a switch of high reliability in which built-in components are not detached even when a shock is applied to the switch.

DISCLOSURE OF INVENTION

In order to attain the objects, the invention is configured in the following manner.

The switch of the invention set forth in claim 1 is configured so that the switch comprises: an operating member which is displaced in accordance with an operation performed on an operation face; a switch main unit which actuates according to the displacement of the operating member; and a light source which operates according to the actuation of the switch main unit. The switch main unit and the light source are mounted on a same circuit board, and light from the light source is guided to the operation face by the operating member.

According to the invention, light from the light source is guided to the operation face by the operating member, and hence the light source and the switch main unit can be mounted on the same circuit board. As compared with the conventional art example in which individual boards are disposed, therefore, the cost can be lowered and the space can be reduced. Since light is guided through the operating member which drives the switch main unit, furthermore, it is not required to separately dispose light guiding means.

The switch of the invention is configured so that the operating member is displaceably built into the case to engage an engaging portion of the operating member with an engagement receiving portion of the case. A blocking member is disposed in an open internal space of the operating member. The blocking member abutts against an inner wall of the operating member and blocks the operating member from being bent inward, to hold the engagement state with the case.

According to the invention, the blocking member which blocks the operating member from being bent inward is disposed in the open internal space of the operating member which is displaceably built into the case. Even when a shock is applied by an excessive operation or the like, therefore, the operating member is not bent inward and the engagement state is not canceled. As a result, a switch of high reliability is obtained.

The switch of the invention is configured so that the operating member is displaceably built into the case to engage an engaging portion of the operating member with an engagement receiving portion of the case. A base on which the circuit board is mounted is coupled to the case, and a blocking portion which protrudes from the base is positioned in an open internal space of the operating member, to abut against an inner wall of the operating member. Thus, the operating member is blocked from being bent inward, to hold the engagement state with the case.

According to the invention, in order to block the operating member from being bent inward, the blocking portion which protrudes from the base is positioned in the open internal space of the operating member which is displaceably built into the case. As a result, even when a shock is applied by an excessive operation or the like, the operating member is not bent inward, the engagement state is not canceled, and a switch of high reliability is obtained.

The switch of the invention is configured so that an engaging hole is formed in the case, an engaging protrusion which is to be engaged with the engaging hole is formed on the operating member, a pair of holding grooves which hold ends of the plate-like blocking member are formed in the inner wall of the operating member, and an engagingly locking protrusion which is to be engagingly locked with an engaging hole formed in the blocking member protrudes from the inner wall of the operating member.

According to the invention, the plate-like blocking member is securely held by the holding grooves and the engagingly locking protrusion formed in the inner wall of the operating member. Therefore, the operating member can be more surely prevented from dropping off from the case.

The switch of the invention is configured so that the operating member is formed into a bottomed cylindrical shape, and built so that a bottom is positioned in an upper portion of the cylindrical case. An open end is positioned in a lower portion of the cylindrical case, slits are formed in a peripheral wall of the operating member on a side of the open end to branch the operating member into plural portions, a base on which the circuit board is mounted is fittingly coupled to the case from a lower end opening of the case, and the switch main unit mounted on the circuit board is positioned in an internal space of the operating member from the open end of the operating member.

According to the invention, slits are formed in the peripheral wall of the operating member on the side of the open end, to branch the operating member into plural portions. During a process of incorporating the operating member into the cylindrical case, therefore, the branched peripheral wall of the operating member is bent inward, so that the incorporation can be smoothly conducted. This further allows the open internal space of the operating member to be effectively used as a space for disposing the switch main unit.

BEST MODE FOR CARRYING OUT THE INVENTION

Figure 1:
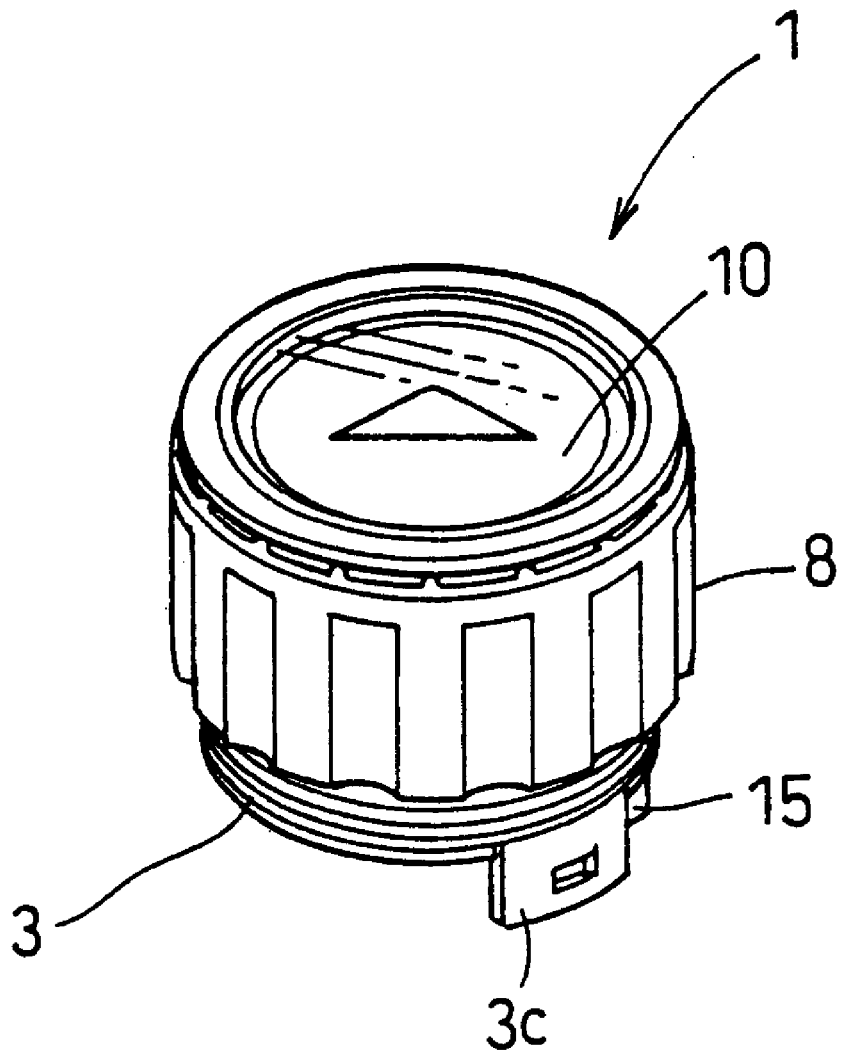
FIG. 1 is an external perspective view of the whole of a push button switch according to the invention.
Figure 2:
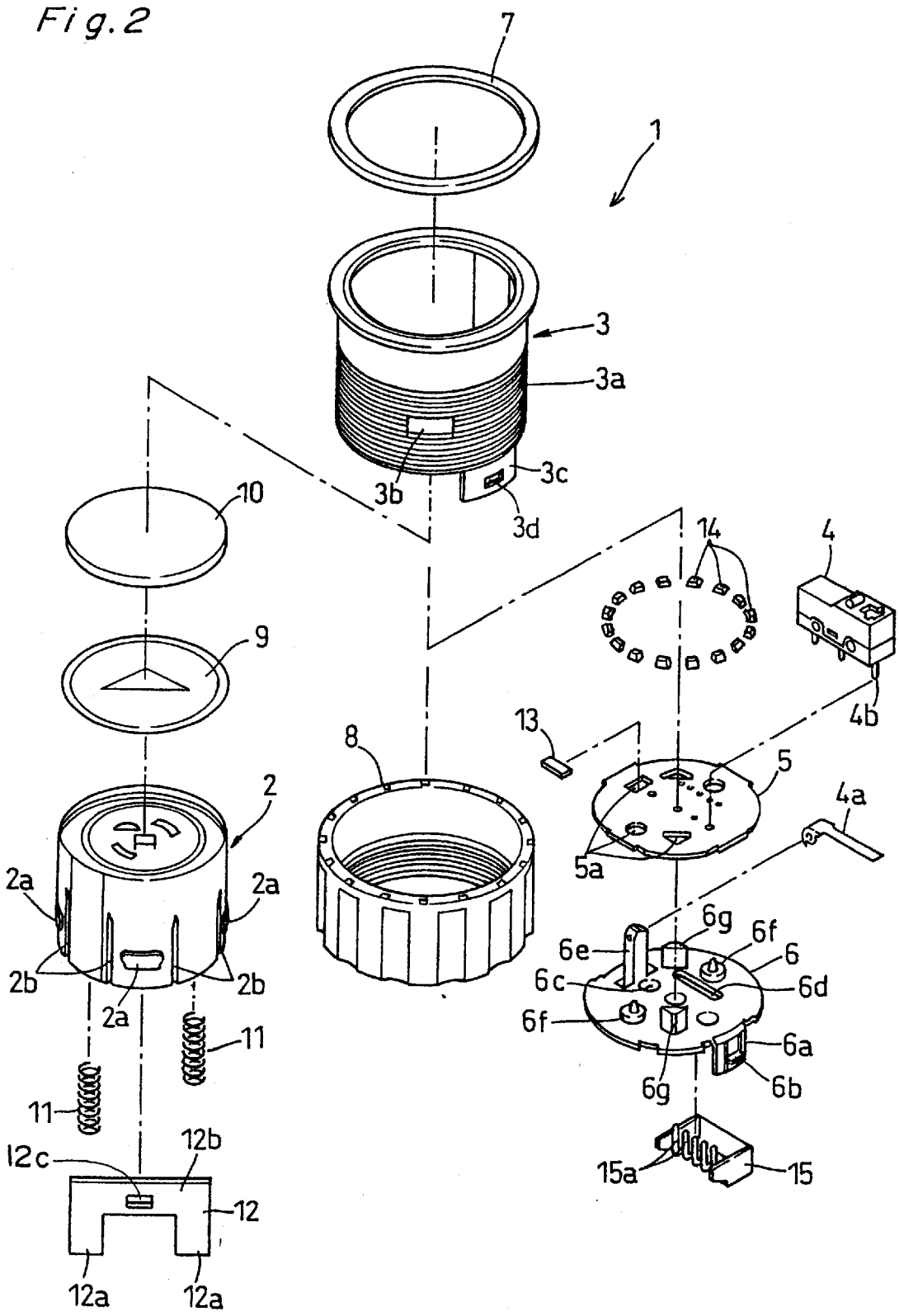
FIG. 2 is an exploded perspective view of the whole of the switch.

Hereinafter, an embodiment of the invention will be described with reference to the drawings. FIG. 1 is an external perspective view of an illuminated push button switch of the invention, FIG. 2 is an exploded perspective view of the switch, and FIGS. 3 to 6 are vertical section views of the switch.

The push button switch 1 is applied to, for example, a push button switch for an elevator. A case 3 and a base 6 are fittingly coupled to each other so as to be separable as described later. An operative plunger 2 serving as the operating member, and the like are housed in the case 3. A microswitch 4 serving as the switch main unit, a circuit board 5, and the like are mounted on the base 6.

The case 3 is a resin molded product which is substantially cylindrical. A flange 7 is attached to an upper edge of the case, and the operative plunger 2 and the like are built into the case as described later. A thread portion 3*a* is formed on the case 3. An attaching ring 8 is screwed and fastened to the thread portion to attach the case 3 to an attachment hole of an operation panel which is not shown.

Rectangular engaging holes 3*b* for enabling the operative plunger 2 to be built so as to be operatively displaceable in vertical directions are formed in four positions in the circumferential direction of the case 3, respectively. On the other hand, in the operative plunger 2 which is made of a transparent resin material, engaging protrusions 2*a* which are to be engaged with the engaging holes 3*b* are formed in four positions of the outer periphery, respectively. The engaging protrusions 2*a* are displaceably engaged with the engaging holes 3*b* of the case 3, whereby the operative plunger 2 is built into the case 3 so as to be operatively displaceable.

A pair of opposing legs 3*c* downward elongate from a lower portion of the case 3 in a cantilevered manner. On the other hand, a pair of opposing legs 6*a* which correspond to the legs 3*c* of the case 3 elongate from a lower portion of a substantially disk-like shaped resin base 6. Engaging holes 3*d* are formed in the legs 3*c* of the case 3, respectively. By contrast, engaging protrusions 6*b* which are to be engaged with the engaging holes 3*d* are formed on the legs 6*a* of the base 6, respectively. When the operative plunger 2 and the like are attached into the case 3 and the above-mentioned legs 3*c* and 6*a* are then engaged with each other, therefore, the case 3 and the base 6 are fittingly coupled to each other in a state where they are relatively positioned.

The operative plunger 2 is formed into a bottomed cylindrical shape. A peripheral wall of the plunger on the side of the lower open end is branched into plural portions by forming slits 2*b* elongating in the longitudinal direction, in plural positions arranged along the circumferential direction, in order that, when the operative plunger 2 is to be inserted into the cylindrical case 3 to be built thereinto, the peripheral wall may bend inward to allow the insertion to be smoothly conducted. The engaging protrusions 2*a* are formed on the outer peripheries of four opposing ones of the branched portions, respectively.

Figure 4:
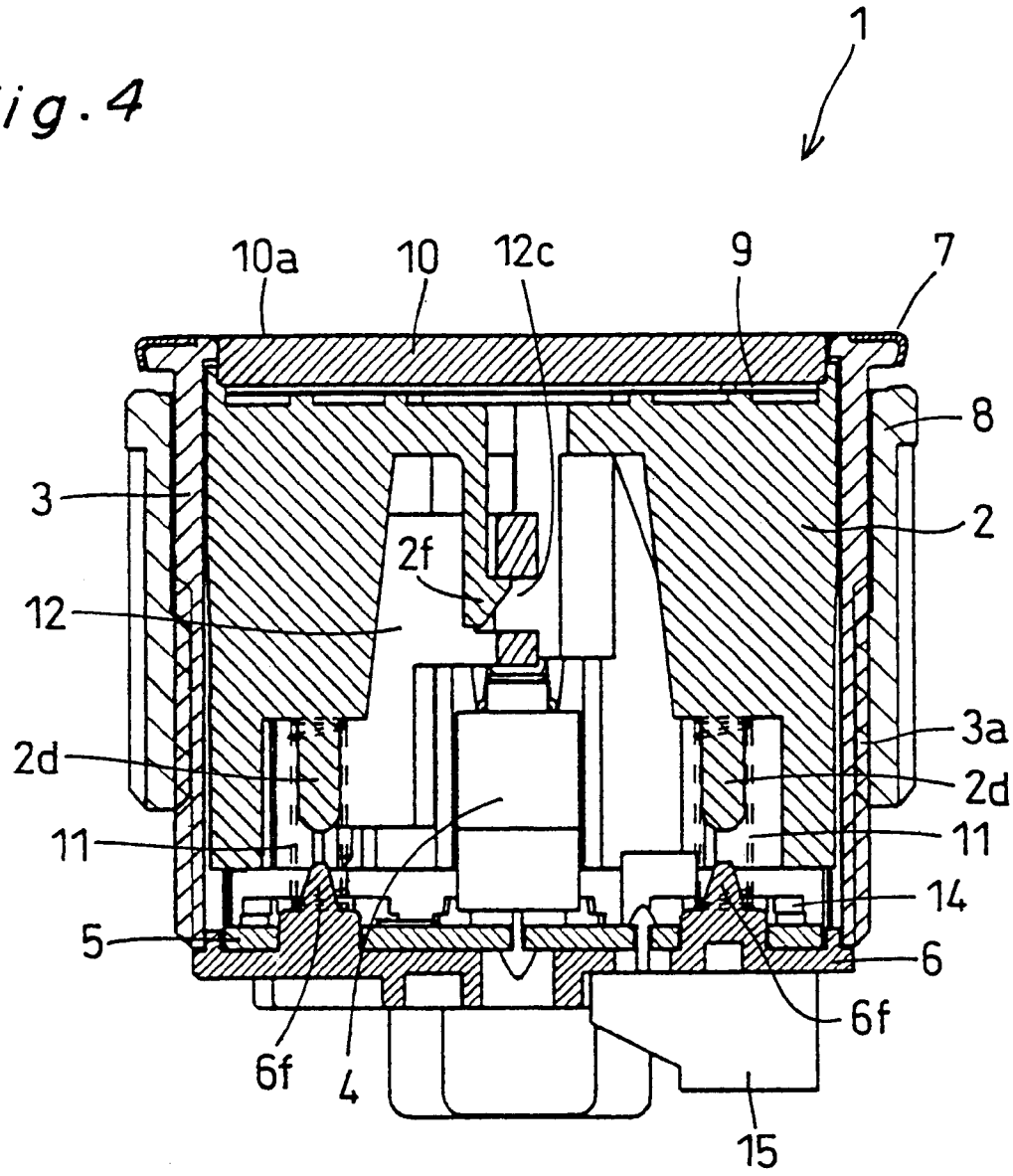
FIG. 4 is a vertical section side view of FIG. 1.
Figure 5:
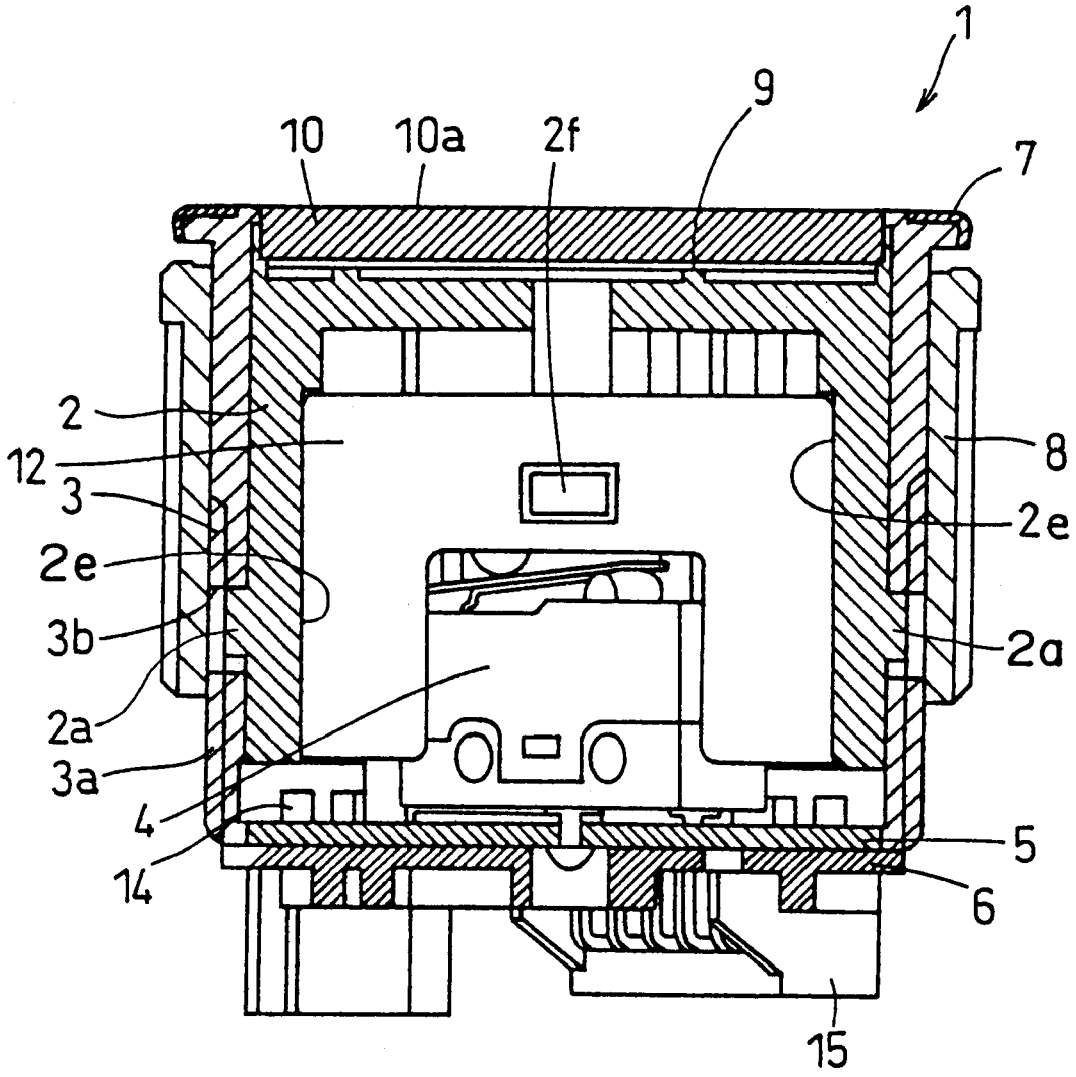
FIG. 5 is a vertical section side view of FIG. 1.

A display plate 9 and a glass plate 10 constituting the operation face are placed on the upper end face of the operative plunger 2, and built into the case 3. The lower portion of the operative plunger 2 is open, and an internal space for housing the microswitch 4 and the like is configured inside the plunger. In the internal space, as shown FIG. 3, a pressing portion 2*c* which presses a lever 4*a* of the microswitch 4 downward protrudes from the inner wall of the upper portion. As shown in FIG. 4, in order to attach a pair of springs 11 for urging in the returning direction, a pair of attaching protrusions 2*d* downward protrude from the operative plunger 2. As shown in FIG. 5, a pair of holding grooves 2*e* which guide and hold a plate 12 that serves as the blocking member and that will be described later are formed in the vertical direction in inner walls of a pair of branched portions on which the engaging protrusions 2*a* are formed. A hook 2*f* serving as an engaging protrusion for preventing the plate 12 from slipping off protrudes downward from the inner wall of the upper portion.

The engaging protrusions 2*a* formed on the outer peripheries of the four branched portions of the plunger are respectively engaged with the engaging holes 3*b* formed in the four positions in the circumferential direction of the case 3 with a so-called snap fit. The operative plunger 2 is built so as to be operatively displaceable. In the embodiment, the pair of branched portions on which the engaging protrusions 2*a* of the operative plunger 2 are formed are blocked from being bent inward, by attaching the metal plate 12 into the internal space of the operative plunger 2. This configuration is employed in order to prevent the phenomenon in which the engaging portions are disengaged by a shock due to an excessive pressing operation on the operation face 10*a* or the like, causing the operative plunger 2 to slip off from the case 3.

The plate 12 has a pair of abutting portions 12*a* which opposingly elongate, and a connecting portion 12*b* through which the abutting portions 12*a* are connected to each other, and is formed into a substantially U-like shape. In order to prevent the plate 12 from escaping from the internal space of the operative plunger 2, an engagingly locking hole 12*c* which is to be engagingly locked with the hook 2*f* that protrudes inside the operative plunger 2 is formed in the connecting portion 12*b*.

Figure 7:
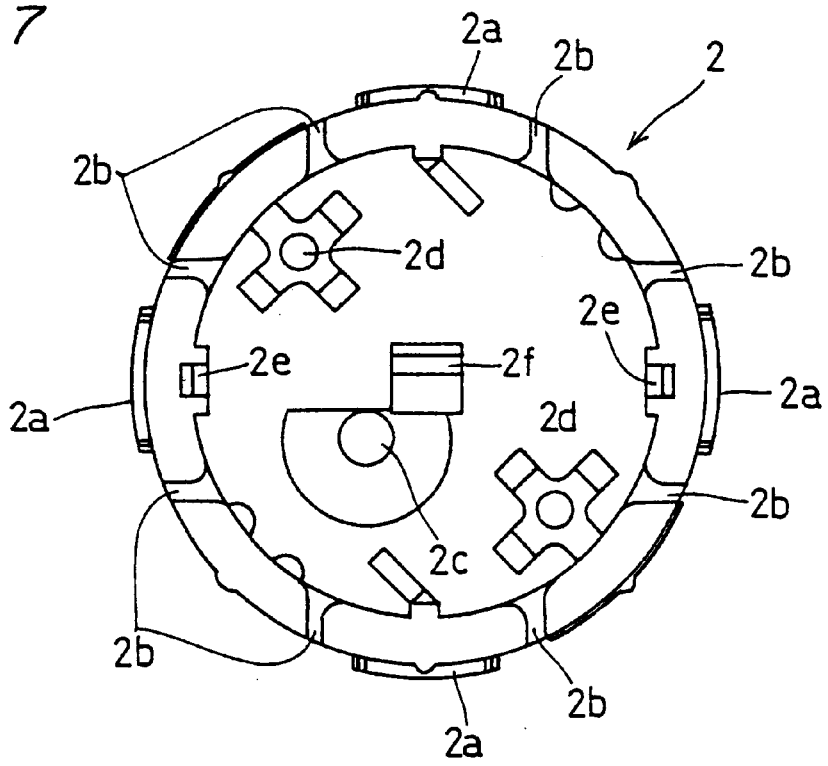
FIG. 7 is a plan view of an operative plunger of FIG. 1.
Figure 8:
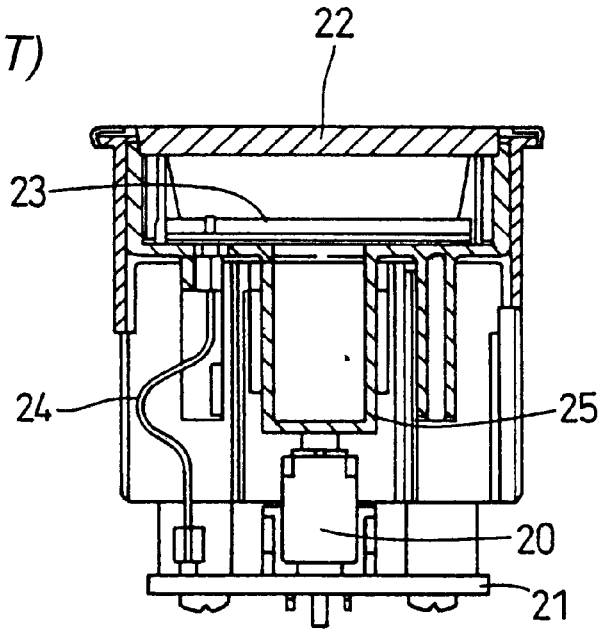
Fig. 8 (PRIOR ART)
FIG. 8 is a section view of a conventional art example.

After the operative plunger 2 is displaceably built into the case 3, as shown in a plan view (FIG. 7) as seen from the lower side of the operative plunger 2, the abutting portions 12*a* of the plate 12 are inserted from the lower side into the holding grooves 2*e* formed in the inner walls of the pair of opposing branched portions of the operative plunger 2, respectively. Thereafter, the engagingly locking hole 12*c* of the connecting portion 12*b* is engagingly locked with the hook 2*f* of the operative plunger 2 to attain attachment.

As a result, the positions of the branched portions on which the engaging protrusions 2*a* of the operative plunger 2 are formed are restricted by the plate 12, and the branched portions are not therefore bent inward. Consequently, the engagement between the engaging protrusions 2*a* which are respectively disposed on the pair of opposing branched portions of the operative plunger 2, and the engaging holes 3*b* of the case 3 can be effectively prevented from being canceled.

In the embodiment, the microswitch 4 which is driven by displacement of the operative plunger 2, and a resistor 13 are mounted on the disk-like circuit board 5. On the circuit board 5, moreover, plural LEDs 14 which are light sources for illuminating the edge of the operation face 10*a*, i.e., the periphery of the display plate 9, are mounted along the circumferential direction, and a connector 15 is mounted via the base 6. Through holes 5*a* through which projections of the base 6 are to be passed are formed in the circuit board 5.

The LEDs 14 are arranged so as to be opposed to the lower end of the peripheral wall of the operative plunger 2. Therefore, light of the LEDs 14 is diffusedly guided through the operative plunger 2 to the operation face 10*a* on the upper side. Because light of the LEDs 14 is guided by the operative plunger 2 to the operation face 10*a* on the upper side in this way, the LEDs 14 and the microswitch 4 which is placed in the lower portion can be mounted on the same circuit board 5. Unlike the above-described conventional art example, therefore, it is not required to separately dispose a switch circuit board and an illumination circuit board. As a result, the cost can be lowered, and the space can be reduced. Since light is guided to the operation face 10*a* through the operative plunger 2 which drives the microswitch 4, moreover, it is not required to separately dispose light guiding means.

Figure 6:
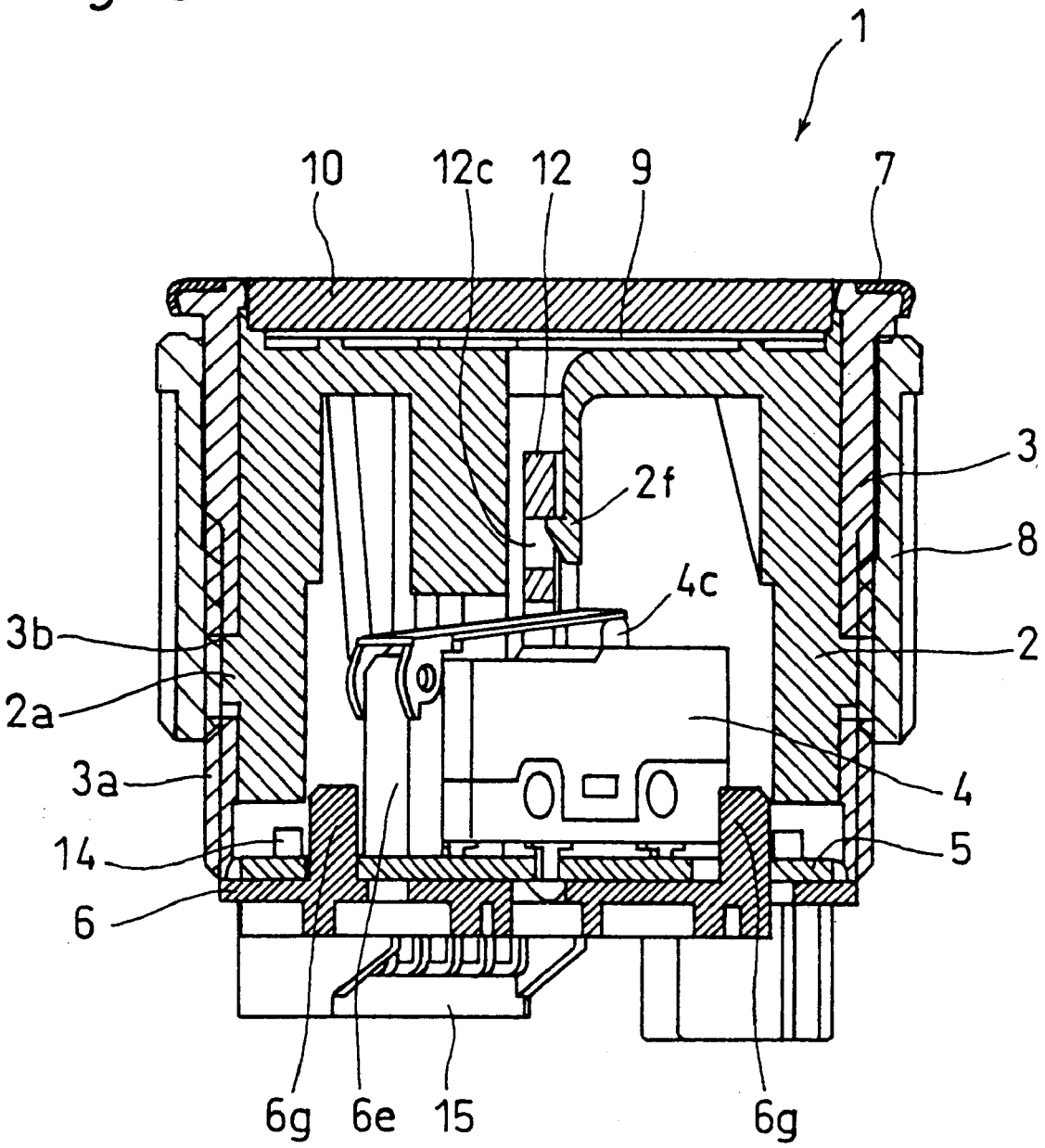
FIG. 6 is a vertical section side view of FIG. 1.

Through holes 6*c* and 6*d* through which lead terminals 4*b* of the microswitch 4 and terminals 15*a* of the connector 15 which are mounted on the circuit board 5 can be passed are formed in the resin base 6. A supporting column 6*e* which supports a basal end portion of the lever 4*a* of the microswitch 4 upstands from the base 6. Receiving portions 6*f* which respectively receive the springs 11 for urging the operative plunger 2 in the returning direction protrude from the base 6 so as to be opposed to each other. As shown in FIG. 6, a pair of locking protrusions 6*g* protrude from the base 6 so as to be opposed to each other. This configuration is employed in order to block the pair of branched portions on which the engaging protrusions 2*a* of the operative plunger 2 are formed, from being bent inward, and prevent the engagement between the case 3 and the operative plunger 2 from being canceled.

In the embodiment, namely, among the four branched portions on which the engaging protrusions 2*a* of the operative plunger 2 are formed, the pair of opposing branched portions are blocked from being bent inward, by the plate 12 which is attached to the inside of the operative plunger 2. On the other hand, the positions of the pair of branched portions on which the engaging protrusions 2*a* are formed in a direction perpendicular to the plate 12 are restricted by the locking protrusions 6*g* of the base 6, to be blocked from being bent inward. According to this configuration, the engagement between the case 3 and the operative plunger 2 which is built into the case 3 is not cancelled by a shock or the like, and the operative plunger 2 can be prevented from dropping off from the case.

In the thus configured push button switch 1, when the operation face 10*a* is pressed, the operative plunger 2 is downward displaced against the urging force of the spring 11. The pressing portion 2*c* which is placed inside the switch 1 presses the lever 4*a* of the microswitch 4 to drive the microswitch 4. As a result, the LEDs 14 emit light, and the light is diffused and guided via the operative plunger 2 to the operation face 10*a* on the upper side, to illuminate the edge of the display plate 9.

Figure 3:
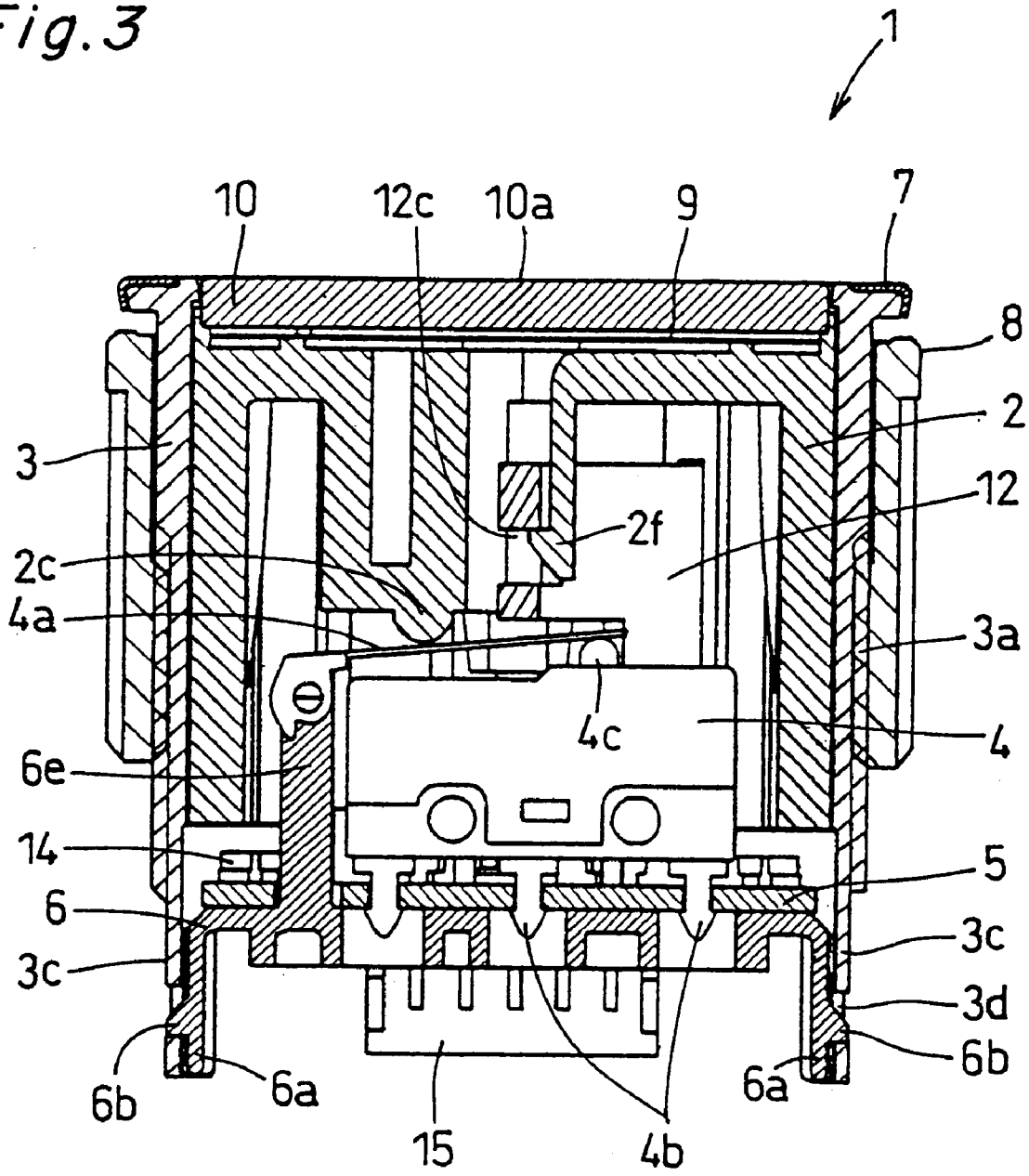
FIG. 3 is a vertical section side view of FIG. 1.

In the embodiment, as shown in FIG. 3, the pressing portion 2*c* of the operative plunger 2 presses the basal end side of the lever 4*a* of the microswitch 4 to operate an operating portion 4*c* on the side of the free end. Therefore, the microswitch 4 can be driven by a small operation stroke of the operation face 10*a*.

In the embodiment, the engagement between the case 3 and the operative plunger 2 is prevented from being canceled, by both the plate 12 and the locking protrusions 6*g* protruding from the base 6. In another embodiment of the invention, the engagement may be prevented from being canceled, by only either of the two means. In the other embodiment, the shape, the number, and the like of the plate 12 and the locking protrusions 6*g* can be adequately selected.

In the embodiment, the plural LEDs 14 are arranged along the circumferential direction, and the edge of the operation face 10*a* is illuminated via the operative plunger 2. However, the invention is not restricted to this. In a further embodiment of the invention, the whole face of the operation face 10*a* may be illuminated.

In the embodiment, the engaging holes 3*b* are formed in the case 3, and the engaging protrusions 2*a* are formed on the operative plunger 2. In a further embodiment of the invention, engaging protrusions may be formed on the case, and engaging holes or engaging recesses may be formed in the operative plunger.

Industrial Applicability

The application of the present invention is not restricted to a push button switch for an elevator, and the invention may be applied to other illuminated push button switches.

What is claimed is:

1. A switch comprising:

an operating member having an engaging portion, wherein the operating member is displaceably built into a case and is displaced in accordance with an operation performed on an operation face, and wherein said engaging portion engages with an engagement receiving portion of said cage;

a switch main unit which actuates according to the displacement of said operating member;

a light source which operates according to the actuation of said switch main unit, wherein light from said light source is guided to said operation face by said operating member;

a circuit board upon which both said switch main unit and said light source are mounted; and a blocking member disposed in an open internal space of said operating member, wherein said blocking member abutts against an inner wall of said operating member and blocks said operating member from being bent inward, to maintain engagement with said case.

2. A switch according to claim 1, further comprising:

a base, coupled to said case, on which said circuit board is mounted; and a blocking portion protruding from said base, positioned in an open internal space of the operating member, and abutting against an inner wall of said operating member, to block said operating member from being bent inward, to maintain engagement with said case.

3. A switch according to claim 1, further comprising:

an engaging hole formed in said case;

an engaging protrusion which is to be engaged with said engaging hole and which is formed on said operating member;

a pair of holding grooves which hold ends of said blocking member are formed in said inner wall of said operating member; and an engagingly locking protrusion which is to be engagingly locked with an engaging hole formed in said blocking member and which protrudes from said inner wall of said operating member.

4. A switch according to claim 1, further comprising:

a base on which said circuit board is mounted is fittingly coupled to said case from a lower end opening of said case; and slits formed in a peripheral wall of said operating member on a side of said open end, to branch said operating member into plural portions, wherein said switch main unit mounted on said circuit board is positioned in an internal space of said operating member from said open end of said operating member, and wherein said operating member is formed into a bottomed cylindrical shape, and built so that a bottom is positioned in an upper portion of said cylindrical case and an open end is positioned in a lower portion of said cylindrical case.

5. A switch comprising:

an operating member which is displaced in accordance with an operation performed on an face;

a case into which said operating member is displaceably built, said case engaging an engaging portion of said operating member with an engagement receiving portion of said case;

a switch main unit which actuates according to the displacement of said operating member;

a light source which operates according to the actuation of said switch main unit, wherein light from said light source is guided to said operation face by said operating member;

a circuit board upon which said switch main unit and said light source are mounted;

a base upon which said circuit board is mounted, wherein said base is coupled to said case; and a blocking member protruding from said base and disposed in an open internal space of said operating member, wherein said blocking member abutts against an inner wall of said operating member and blocks said operating member from being bent inward, to maintain engagement with said case.

* * * * *